US009417591B2

(12) United States Patent
Harada

(10) Patent No.: US 9,417,591 B2
(45) Date of Patent: Aug. 16, 2016

(54) PRINTING APPARATUS, METHOD FOR CONTROLLING PRINTING APPARATUS, AND STORAGE MEDIUM

(71) Applicant: CANON KABUSHIKI KAISHA, Tokyo (JP)

(72) Inventor: Takuto Harada, Yorktown, VA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/670,787

(22) Filed: Mar. 27, 2015

(65) Prior Publication Data

US 2015/0277325 A1 Oct. 1, 2015

(30) Foreign Application Priority Data

Mar. 28, 2014 (JP) ..... 2014-068258

(51) Int. Cl.

| | |
|---|---|
| ***G03G 15/00*** | (2006.01) |
| ***G03G 15/23*** | (2006.01) |
| *G03G 13/23* | (2006.01) |

(52) U.S. Cl.

CPC ..... *G03G 15/6591* (2013.01); *G03G 15/23* (2013.01); *G03G 15/231* (2013.01); *G03G 15/5062* (2013.01); *G03G 13/23* (2013.01); *G03G 15/6538* (2013.01); *G03G 2215/00265* (2013.01); *G03G 2215/00497* (2013.01); *G03G 2215/00502* (2013.01); *G03G 2215/00751* (2013.01); *G03G 2215/00869* (2013.01)

(58) Field of Classification Search

CPC . G03G 15/23; G03G 15/231; G03G 15/5062; G03G 15/6591; G03G 13/23; G03G 2215/00265; G03G 2215/00497; G03G 2215/00502; G03G 2215/00751; G03G 15/6538; G03G 2215/00869

See application file for complete search history.

(56) References Cited

U.S. PATENT DOCUMENTS

2003/0210921 A1* 11/2003 Ueda ..... G03G 15/231 399/82

FOREIGN PATENT DOCUMENTS

| | | | |
|---|---|---|---|
| JP | 11243486 A | * | 9/1999 |
| JP | 2005-216032 A | | 8/2005 |

* cited by examiner

*Primary Examiner* — Ryan Walsh

(74) *Attorney, Agent, or Firm* — Canon U.S.A., Inc. IP Division

(57) ABSTRACT

A printing apparatus includes a determination unit configured to determine, based on a print side designated for a transparent sheet and a print side on which the printing apparatus is able to execute printing, a print side of an image to be printed on the transparent sheet and sheet feeding timing of the transparent sheet, and a printing unit configured to print the image on the transparent sheet based on a content determined by the determination unit.

8 Claims, 16 Drawing Sheets

[IN CASE OF LONGITUDINAL PATH ENGINE]

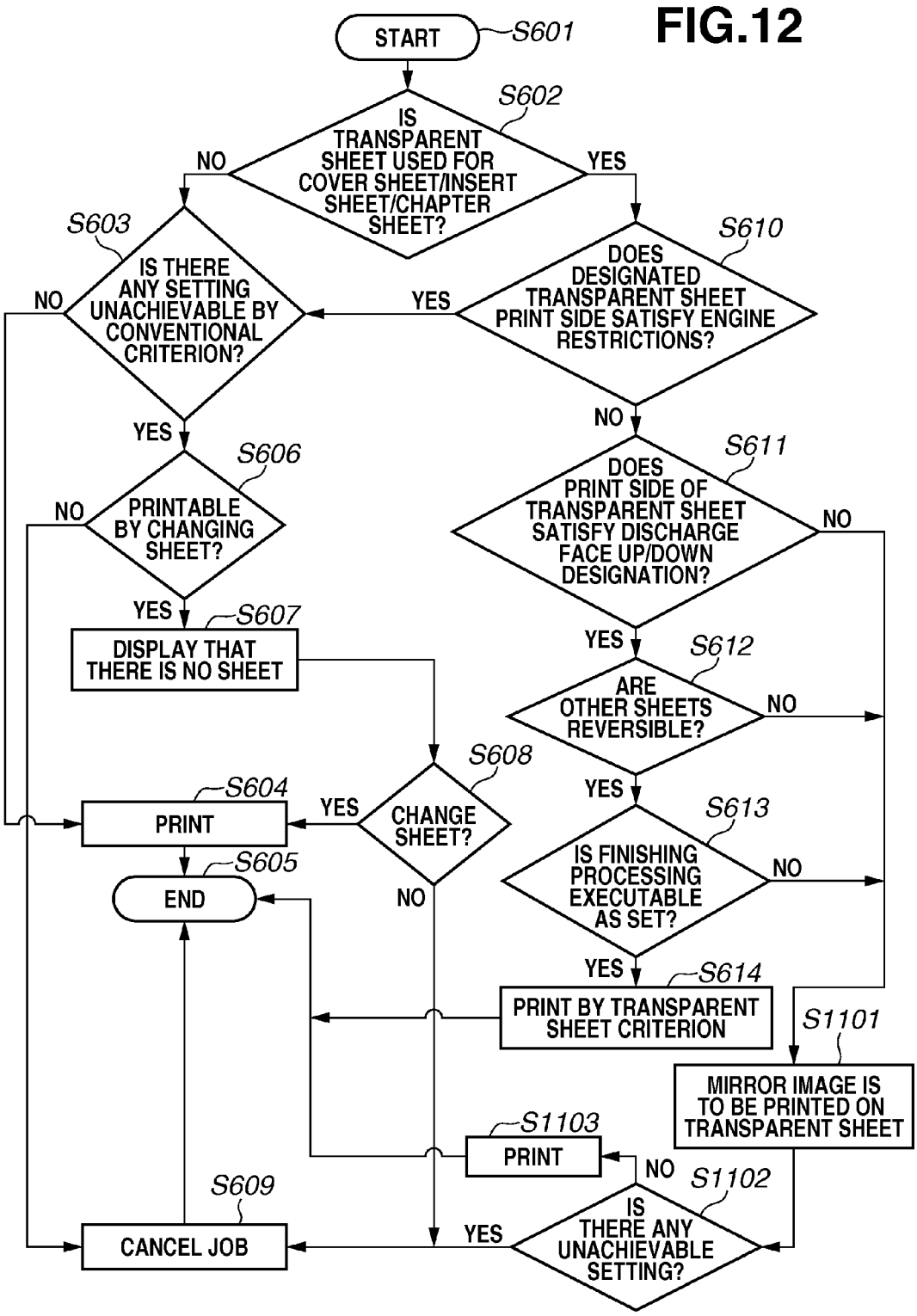
FIG.12
START
S601
S602
IS TRANSPARENT SHEET USED FOR COVER SHEET/INSERT SHEET/CHAPTER SHEET?
NO
YES
S603
IS THERE ANY SETTING UNACHIEVABLE BY CONVENTIONAL CRITERION?
S610
DOES DESIGNATED TRANSPARENT SHEET PRINT SIDE SATISFY ENGINE RESTRICTIONS?
S606
PRINTABLE BY CHANGING SHEET?
S611
DOES PRINT SIDE OF TRANSPARENT SHEET SATISFY DISCHARGE FACE UP/DOWN DESIGNATION?
S607
DISPLAY THAT THERE IS NO SHEET
S612
ARE OTHER SHEETS REVERSIBLE?
S608
CHANGE SHEET?
S604
PRINT
S605
END
S613
IS FINISHING PROCESSING EXECUTABLE AS SET?
S614
PRINT BY TRANSPARENT SHEET CRITERION
S1101
MIRROR IMAGE IS TO BE PRINTED ON TRANSPARENT SHEET
S1103
PRINT
S1102
IS THERE ANY UNACHIEVABLE SETTING?
S609
CANCEL JOB

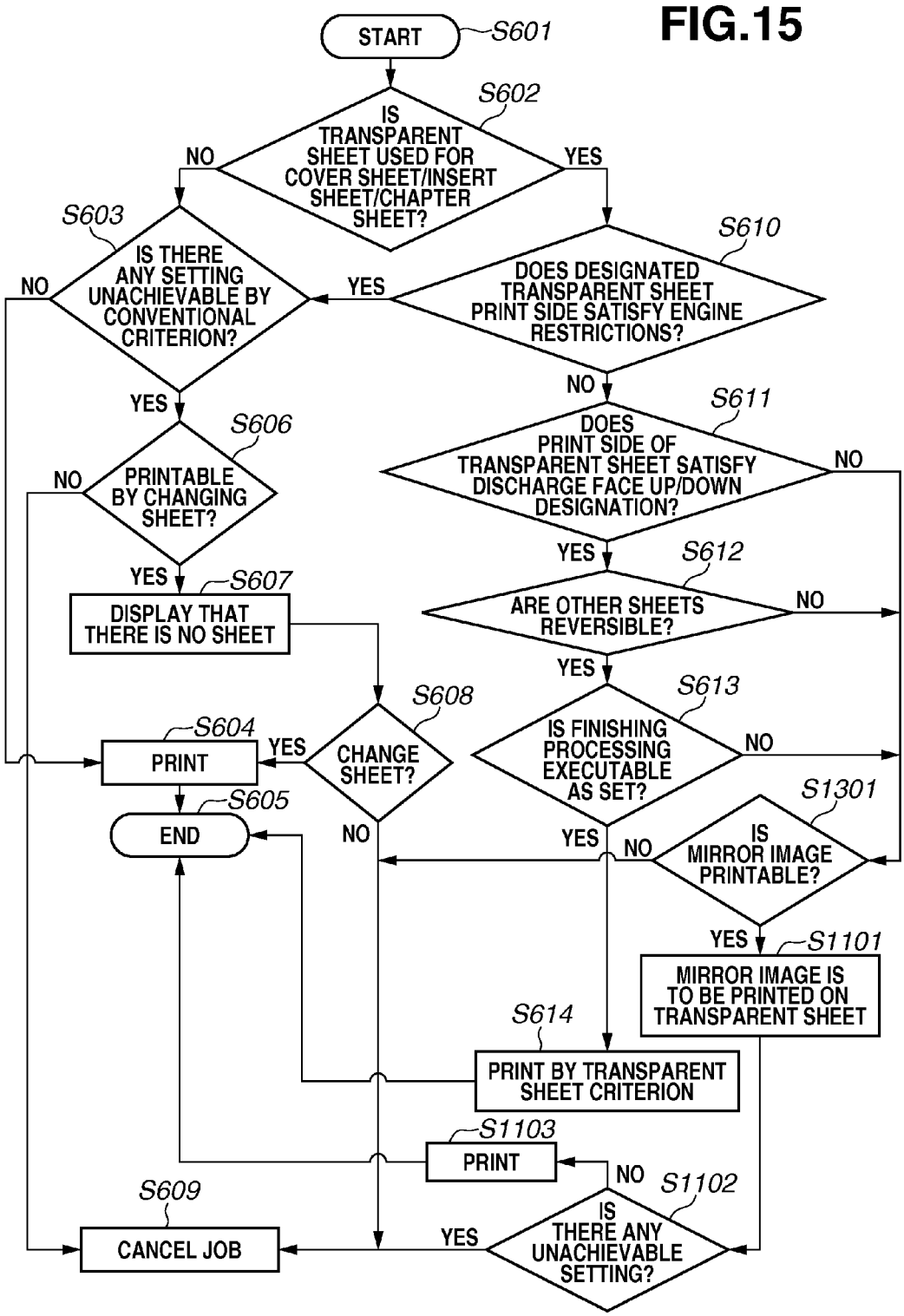
FIG.15
START
S601
S602
IS TRANSPARENT SHEET USED FOR COVER SHEET/INSERT SHEET/CHAPTER SHEET?
NO
YES
S603
IS THERE ANY SETTING UNACHIEVABLE BY CONVENTIONAL CRITERION?
NO
YES
S610
DOES DESIGNATED TRANSPARENT SHEET PRINT SIDE SATISFY ENGINE RESTRICTIONS?
YES
NO
S606
PRINTABLE BY CHANGING SHEET?
NO
YES
S611
DOES PRINT SIDE OF TRANSPARENT SHEET SATISFY DISCHARGE FACE UP/DOWN DESIGNATION?
NO
YES
S612
ARE OTHER SHEETS REVERSIBLE?
NO
YES
S607
DISPLAY THAT THERE IS NO SHEET
S608
CHANGE SHEET?
YES
NO
S613
IS FINISHING PROCESSING EXECUTABLE AS SET?
NO
YES
S604
PRINT
S605
END
S1301
IS MIRROR IMAGE PRINTABLE?
NO
YES
S1101
MIRROR IMAGE IS TO BE PRINTED ON TRANSPARENT SHEET
S614
PRINT BY TRANSPARENT SHEET CRITERION
S1103
PRINT
NO
S1102
IS THERE ANY UNACHIEVABLE SETTING?
YES
S609
CANCEL JOB

PRINTING APPARATUS, METHOD FOR CONTROLLING PRINTING APPARATUS, AND STORAGE MEDIUM

BACKGROUND OF THE INVENTION

1. Field of the Invention

The present invention relates to a printing apparatus, a method for controlling the printing apparatus, and a storage medium.

2. Description of the Related Art

Reverse or two-sided printing of a transparent film sheet, such as an overhead projector (OHP) film, is difficult as it is weak to heat and is high in hardness. The OHP film is assumed to be used for projecting an image via a projector, and thus a desired print seen from the front is acquired even in a case where the image is printed on the back of the sheet. Therefore, according to a technique discussed in Japanese Patent Application Laid-Open No. 2005-216032, in a case where printing is performed on the OHP film, an image to be printed is printed in a normal image or a mirror image according to a print side of a printing apparatus.

Specifically, in a case where printing is executed without reversing a fed sheet, in a printing apparatus configured such that the sheet is discharged to a sheet output port with its print side facing down (hereinafter, referred to as longitudinal path engine), an image to be printed is printed in a normal image on the print side in printing on the OHP film. As a result, the sheet is discharged with the print side, on which the normal image has been printed, facing down. In a case where the printing is executed without reversing a fed sheet, in a printing apparatus configured such that the sheet is discharged to a sheet output port with its print side facing up (hereinafter, referred to as straight path engine), an image to be printed is converted into a mirror image and printed on the print side in printing on the OHP film.

As a result, the sheet is discharged with the print side, on which the mirror image has been printed, facing up. While the print side of the longitudinal engine and the print side of the straight path engine are different from each other, a print product of which print result is a normal image when the discharged sheet is seen from below can be obtained by both the longitudinal and straight path engines.

Since the aforementioned print processing is performed on the OHP film, processing of similar restrictions is performed in a case where the OHP film is used as a cover sheet, a chapter sheet, or an insert sheet.

There is a print product using a transparent sheet for a cover sheet, a chapter sheet, or an insert sheet. However, because of the aforementioned print processing, the image can only be printed on the front side. This causes problems where an image cannot be printed on a back side within a single job. Further, even in a case where an image is designated to be printed on a front side, a print product in which an image is printed not in a mirror image but in a normal image on the front side is not always obtained. In order to obtain a desired print product in such a case, a user must understand with which of the longitudinal path engine and the straight path engine a printing apparatus used for printing is provided. Then, when the user understands that he/she cannot obtain a desired result from a currently executing printing job, the user is required to divide the printing job and combine two print products, as illustrated in FIG. 16.

SUMMARY OF THE INVENTION

According to an aspect of the present invention, a printing apparatus includes a determination unit configured to determine, based on a print side designated for a transparent sheet and a print side on which the printing apparatus is able to execute printing, a print side of an image to be printed on the transparent sheet and sheet feeding timing of the transparent sheet, and a printing unit configured to print the image on the transparent sheet based on a content determined by the determination unit.

Further features of the present invention will become apparent from the following description of exemplary embodiments (with reference to the attached drawings).

BRIEF DESCRIPTION OF THE DRAWINGS

FIG. 12 is a flowchart illustrating a method for controlling the printing apparatus.

FIG. 15 is a flowchart illustrating a method for controlling the printing apparatus.

DESCRIPTION OF THE EMBODIMENTS

The exemplary embodiments of the present invention will be described with reference to the drawings.

<System Configuration>

Figure 1:
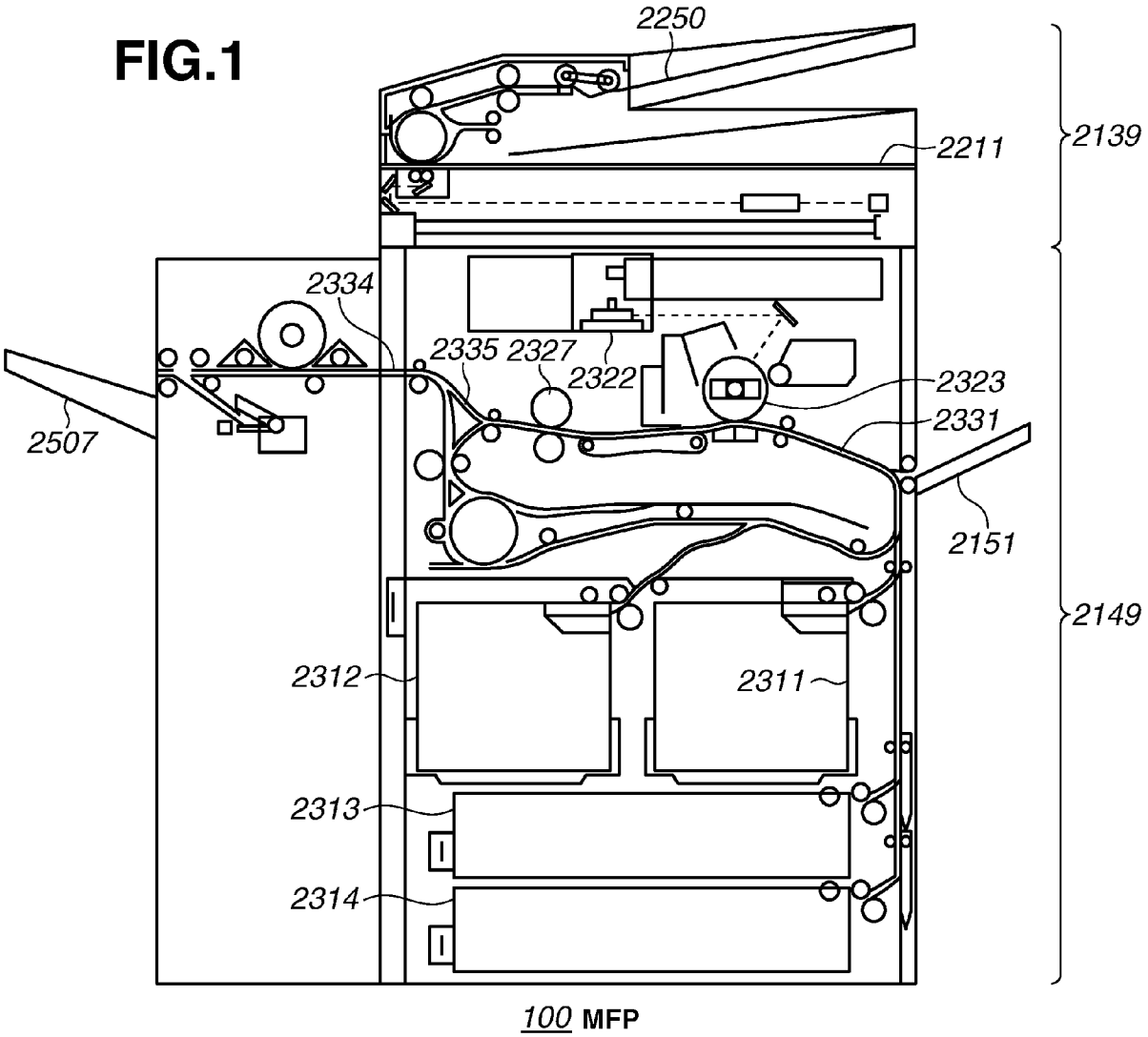
FIG. 1 is a sectional view illustrating a configuration of a printing apparatus according to an exemplary embodiment.

FIG. 1 is a sectional view illustrating a configuration of a printing apparatus according to a first exemplary embodiment. This is an example of the printing apparatus including a path (conveyance path) horizontally extending straight from a manual feed tray to a discharge tray in printing of an image on a transparent sheet. According to the present exemplary embodiment, a multifunction peripheral that includes a scanner unit 2139 and a printer unit 2149 is described as an example of a printing apparatus.

In the example illustrated in FIG. 1, the scanner unit 2139 feeds a document set on a document feeding device 2250, and reads an image via an optical system. The document feeding device 2250 is configured to be open/closable and able to read a sheet document or a book document mounted on a platen glass 2211. A manual feed tray 2151 is used for introducing, to a straight path 2331, a sheet on which an image is to be formed. An image developed on a photosensitive body 2323 by using a developing unit is transferred onto the sheet by a transfer unit. The image is formed by applying a laser beam emitted from a laser scanner unit 2322 to the surface of the photosensitive body 2323. A fixing unit 2327 fixes a developer transferred to the sheet by heat pressure. A conveyance path 2335 is used for conveying, to a post-processing unit, the sheet on which the image has been formed. Sheets on which images have been formed are stacked on a discharge tray 2507. The sheets are housed in feed trays 2311 to 2314. The sheets fed from the manual feed tray 2151 include plain paper, a transparent sheet (PHP film sheet) and the like.

According to the present exemplary embodiment, since the transparent sheet cannot be passed through a curved reversing path, a mirror image is printed from above on the back side of the transparent sheet fed from the manual feed tray 2151.

Figure 2:
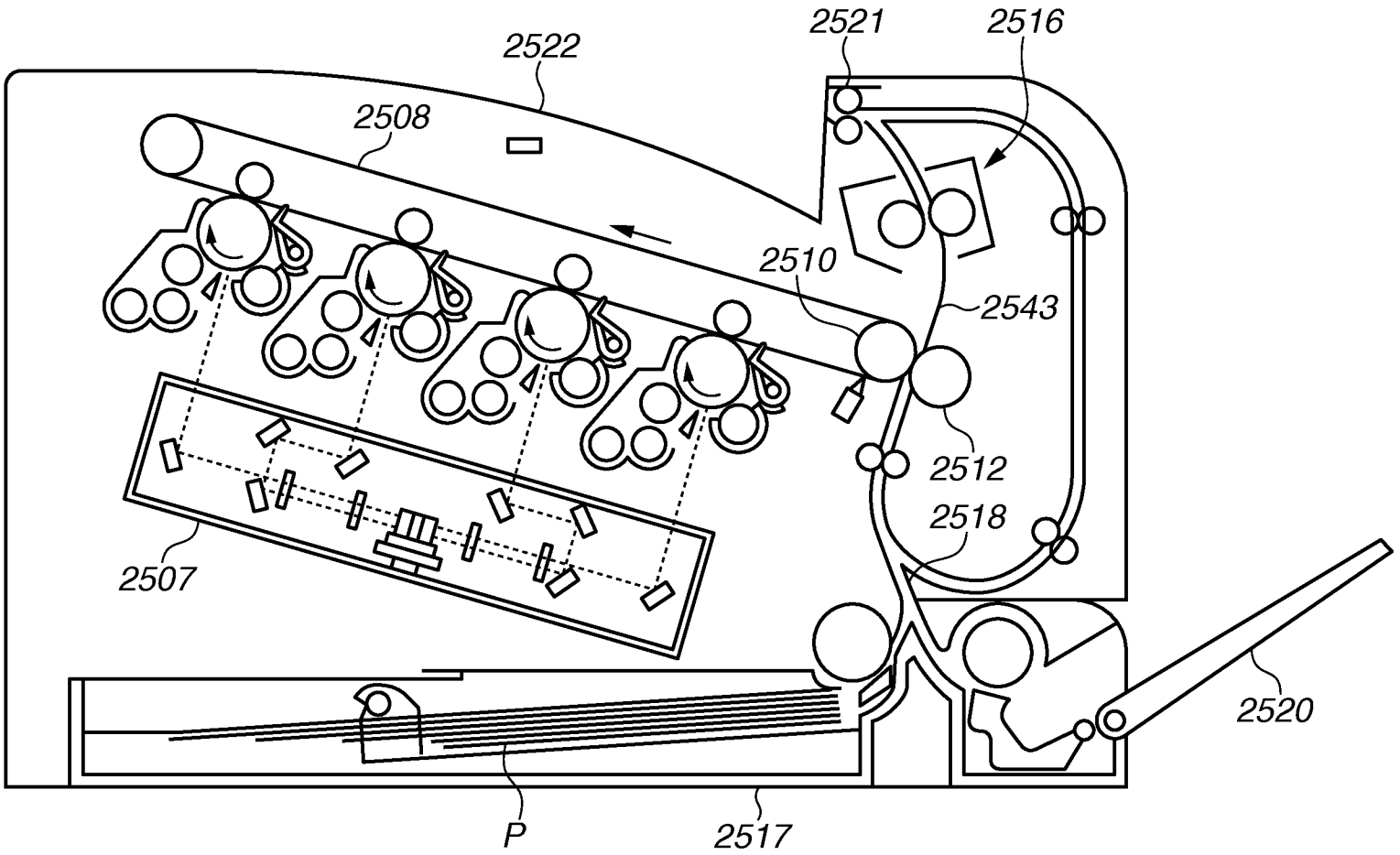
FIG. 2 is a sectional view illustrating a configuration of a printing apparatus according to the present exemplary embodiment.

FIG. 2 is a sectional view illustrating a configuration of a printing apparatus of another type according to the present exemplary embodiment. In printing an image on a transparent sheet, an image formed by each color is transferred to an intermediate transfer body, and the transferred image (normal image) is printed from the left side of the drawing on the front side of the transparent sheet fed along a longitudinal path.

A feed tray 2517 houses sheets P as illustrate in FIG. 2. A manual feed tray 2520 is configured to feed a transparent sheet not illustrated. In the printing apparatus illustrated in FIG. 2, conveyance paths 2518 and 2543 constitute a longitudinal path.

A transfer roller 2521 transfers the image of each color transferred to an intermediate transfer belt 2508 in a normal image to the front side of a fed sheet, and a fixing unit 2516 fixes the image by heat pressure. A discharge roller 2512 discharges the printed sheet to a discharge tray 2522 provided outside the machine.

An optical unit 2507 emits a laser beam modulated based on print data corresponding to respective colors (yellow (Y), magenta (M), cyan (C), and black (BK)).

As described above, the printing apparatus including the straight path can print an image only on the back side of the transparent sheet, while the printing apparatus including the longitudinal path can print an image only on the front side of the sheet. Thus, a user must perform layout or print setting of image data, while being aware which of the straight path and the longitudinal path a printing apparatus to which a job is transmitted is provided with, so that the image can be printed on a correct side of the transparent sheet. Consequently, when erroneous setting is performed, incorrect printing may occur. Hereinafter, printing control performed on the transparent sheet in the printing apparatus according to the present exemplary embodiment will be described in detail. In the printing apparatus adopting an engine configuration illustrated in FIG. 1, an engine transfers the image to an image transfer side of a sheet fed from a feed cassette through a conveyance path, namely, a back side, and an upper side of the fed sheet is a front side. This conveyance path is referred to as the straight path. In the printing apparatus adopting an engine configuration illustrated in FIG. 2, an engine transfers the image to an image transfer side of a sheet fed from a feed cassette through a conveyance path, namely, a front side, and an upper side of the fed sheet is the front side. In other words, a print side of the fed sheet to which the engine transfers the image and a print side of the sheet are identical to each other. This conveyance path is referred to as a longitudinal path. A specific side of the sheet to which the engine transfers the image is referred to as a second print side, while a side (including front and back sides) of the transparent sheet designated by a job using the transparent sheet described below is referred to as a first print side.

Figure 3:
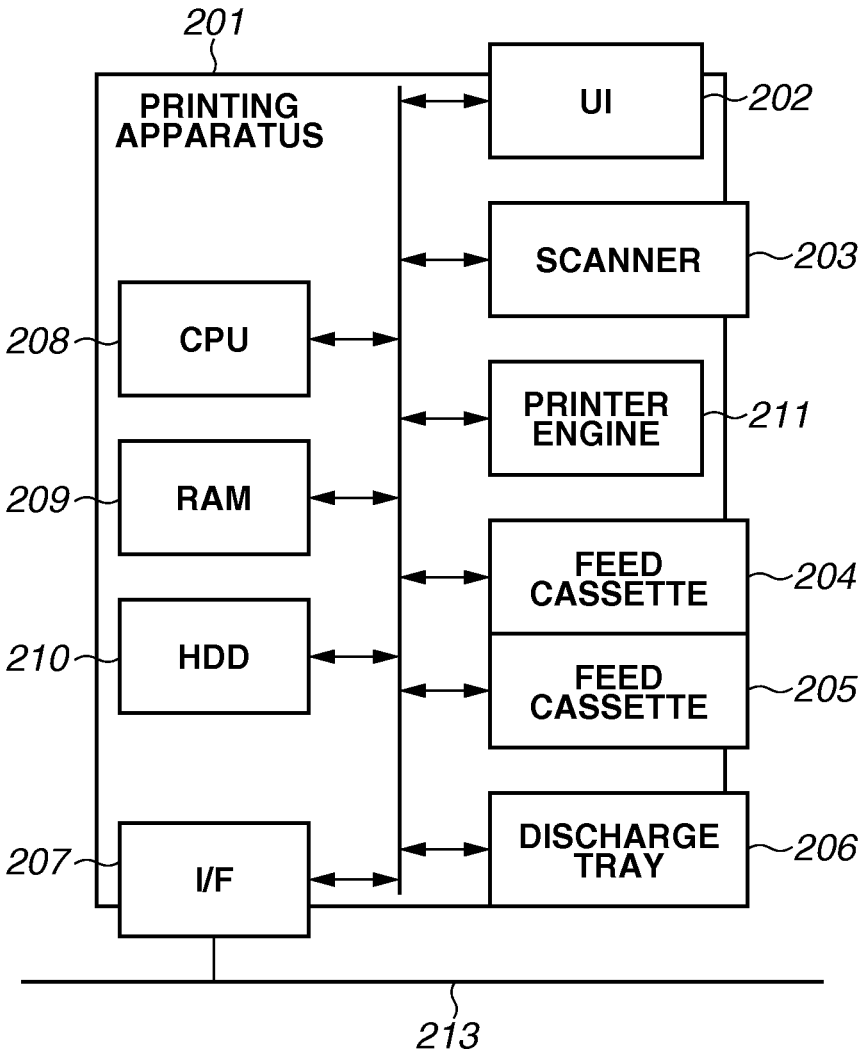
FIG. 3 is a block diagram illustrating a configuration of a printing system to which the printing apparatus is applied.

FIG. 3 is a block diagram illustrating the configuration of the printing system according to the present exemplary embodiment.

The printing apparatus 201 illustrated in FIG. 3 includes a user interface (UI) 202, a scanner 203, feed cassettes 204 and 205, a discharge tray 206, an interface (I/F) 207, and a central processing unit (CPU) 208. The user interface (UI) 202 includes a touch panel or the like not illustrated, and is configured to display a setting screen necessary in the printing apparatus 201 and receive an instruction from the user. The scanner 203 is configured to read a set document by scanning the set document with an optical unit not illustrated. The feed cassettes 204 and 205 are configured to feed sheets. The I/F 207 is configured to communicate with an information processing apparatus or other printing apparatuses connected to a network 213. The CPU 208 is configured to control, by using a random access memory (RAM) 209 as a work memory, each unit by executing a control program.

A hard disk (HDD) 210 is used as an area for storing a control program necessary for controlling the printing apparatus 201, a data file, or a user's job. A printer engine 211 executes printing on the sheets fed from the feed cassettes 204 and 205, and discharges the printed sheets to the discharge tray 206.

Figure 4:
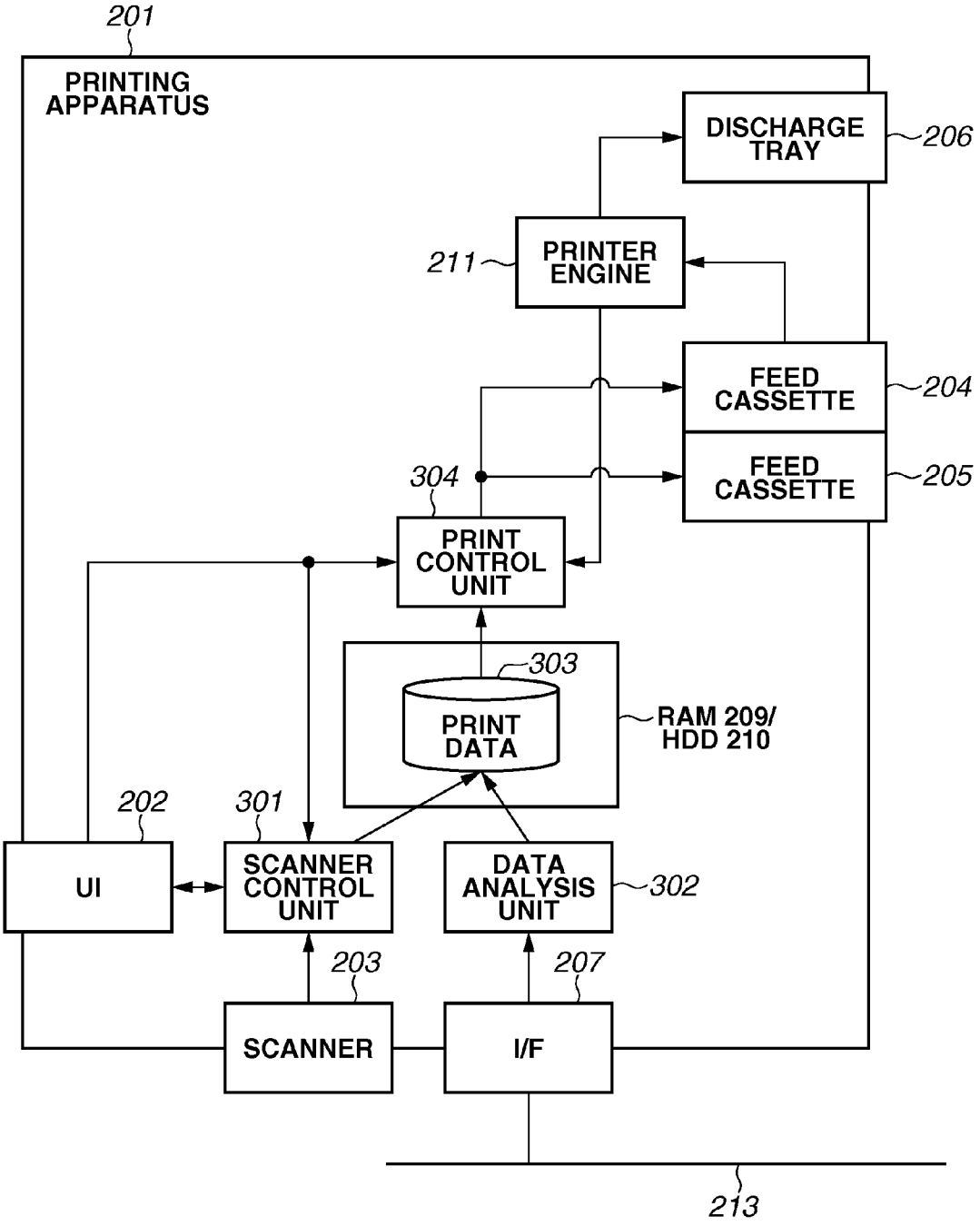
FIG. 4 is a block diagram illustrating a configuration of a software module of the printing apparatus.

FIG. 4 is a block diagram illustrating a configuration of a software module of the printing apparatus illustrated in FIG. 3. The module is operated under control of the CPU 108 in the printing apparatus 201, and the RAM 209 or the HDD 210 are used as a storage device.

A scanner control unit 301 illustrate in FIG. 4 controls reading of a document set on the scanner 203. A data analysis unit 302 stores (spools), in the RAM 209 or the HDD 210, print data 303 generated by analyzing a print job received via the I/F 207. A print control unit 304 executes processing for feeding sheet from the feed cassettes 204 and 205, outputting of the print data to the printer engine 211, and receiving an instruction from the UI 202.

Figure 5:
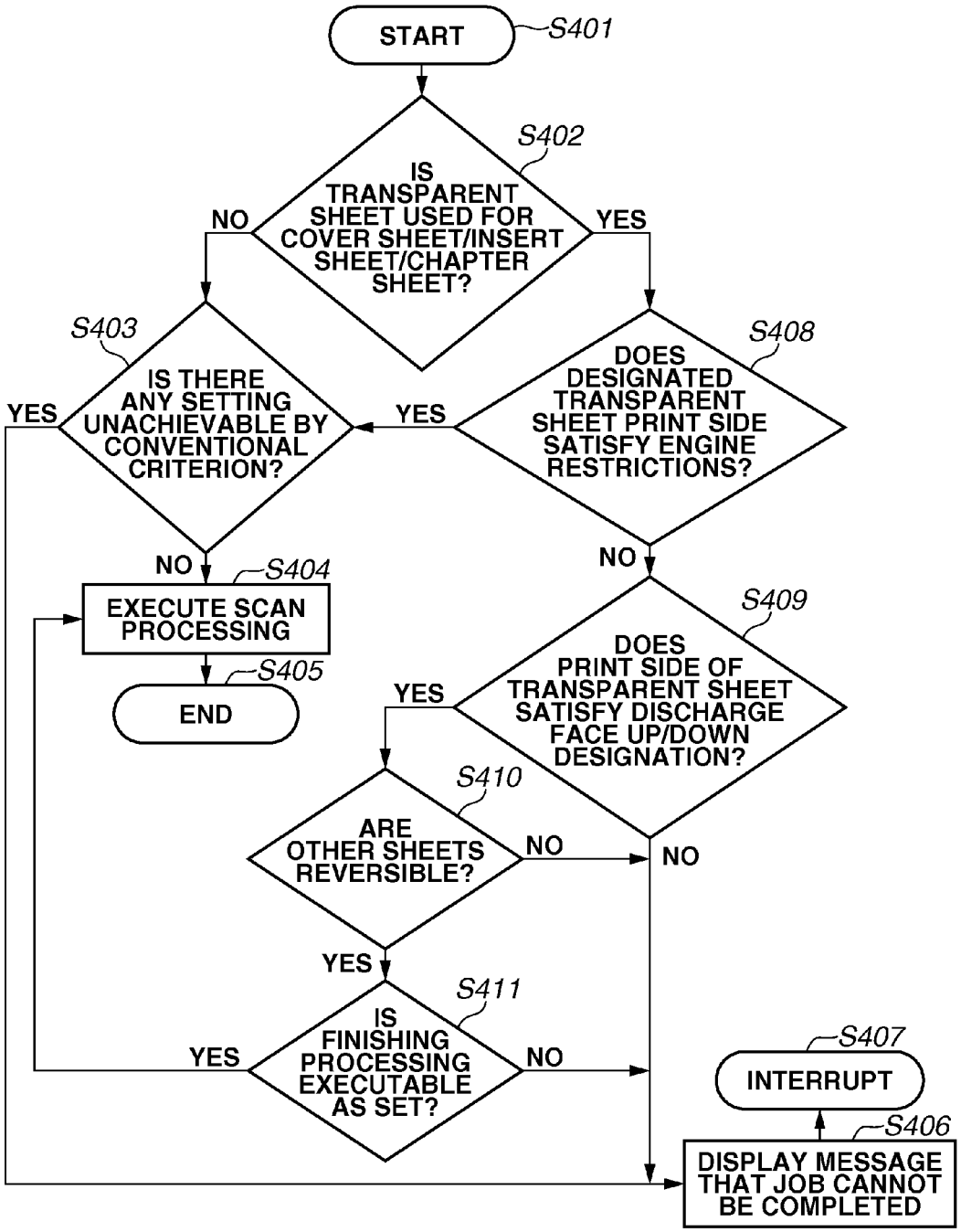
FIG. 5 is a flowchart illustrating a method for controlling the printing apparatus.

FIG. 5 is a flowchart illustrating a method for controlling the printing apparatus according to the present exemplary embodiment. Processing in a copy processing job executed by the scanner control unit 301 up to the point where the print data 303 is obtained from the scanner 203 will be described. Each procedure is achieved through execution of the control program stored in the HDD 210 by the CPU 208. Hereinafter, processing will be appropriately described mainly on the module illustrated in FIG. 3.

In step S401, the processing is started, and the user presses a job start button on the UI 202. In step S402, the scanner control unit 301 analyzes print setting information set by the user using a copy setting screen displayed on the UI 202, and determines whether there is any setting for using the transparent sheet for a cover sheet, a chapter sheet, or an insert sheet.

In a case where the scanner control unit 301 determines that there is no setting for using the transparent sheet for a cover sheet, a chapter sheet, or an insert sheet (NO in step S402), the processing is similar to that of a general case, and thus proceeds to step S403. In step S403, the scanner control unit 301 determines whether there is any unachievable setting in the print setting information set by the user according to a conventional criterion. In a case where the scanner control unit 301 determines that the print setting information set by the user is achievable (NO in step S403), in step S404, the scanner control unit 301 causes the scanner 203 to scan the set document, and stores the print data 303 in the HDD 210.

On the other hand, in a case where the scanner control unit 301 determines that there is unachievable setting in the print setting information set by the user (YES in step S403), the processing proceeds to step S406. In step S406, a message indicating accordingly is displayed on the UI 202. Then, in step S407, the job processing is interrupted.

On the other hand, in a case where the scanner control unit 301 determines that there is setting for using a transparent sheet for a cover sheet, a chapter sheet, or an insert sheet (YES in step S402), in step S408, the print control unit 304 determines whether a print side of the transparent sheet is identical to a print side set in the printer engine 211. In other words, in the case of the printer engine 211 including the longitudinal path illustrated in FIG. 2, the print control unit 304 determines whether printing is executed on the print side, of the transparent sheet, which is a side to be discharged to the sheet output port facing down (Face Down). In the case of the printer engine 211 including the straight path illustrated in FIG. 1, the print control unit 304 determines whether printing is executed on the print side, of the transparent sheet, which is the side to be discharged to the sheet output port facing up (Face Up).

In a case where the scanner control unit 301 determines that the print side (front side) of the transparent sheet is identical to the print side of the printer engine 211 (YES in step S408), printing can be normally executed on the transparent sheet, and general print processing can be performed without performing any special processing according to the present invention. Thus, the processing from step S403 is executed.

On the other hand, in a case where the scanner control unit 301 determines that the print side of the transparent sheet is not identical to the print side of the printer engine 211 (NO in step S408), reversing the transparent sheet is difficult. Therefore, the scanner control unit 301 determines whether a print product can be obtained by reversing sheets other than the transparent sheet.

Thus, the scanner control unit 301 determines whether the user has designated Face Up/Down for sheet discharging via the UI 202. In a case where the scanner control unit 301 determines that the user has designated Face Up/Down for sheet discharging via the UI 202, in step S409, the scanner control unit 301 further determines whether a discharge sheet side of the transparent sheet satisfies the Face Up/Down designation.

In a case where the scanner control unit 301 determines that the discharge sheet side of the transparent sheet does not satisfy the Face Up/Down designation (NO in step S409), in step S406, a message indicating accordingly is displayed on the UI 202. Then, in step S407, the job is interrupted.

As a specific example, a case of the printer engine 211 including the straight path illustrated in FIG. 1 will be described. In a case where printing on the front side of the transparent sheet is designated, and if "Face Up"/"Either is OK" is designated, the user can obtain a desired result. On the other hand, in a case where "Face Down" is designated, the user cannot obtain a desired result. Therefore, the message is output and the job is interrupted.

On the other hand, in a case where the scanner control unit 301 determines that the discharge sheet side of the transparent sheet satisfies the Face Up/Down designation (YES in step S409), in step S410, the scanner control unit 301 performs an inquiry to the printer engine 211 to determine whether sheets other than the transparent sheet can be reversible.

In a case where the scanner control unit 301 determines that there is a sheet not reversible (NO in step S410), in step S406, the message indicating accordingly is displayed on the UI 202. Then, in step S407, the job is interrupted.

On the other hand, in a case where the scanner control unit 301 determines that the sheets other than the transparent sheet are reversible (YES in step S410), in step S411, the scanner control unit 301 further determines whether finishing processing set via the UI 202 by the user can be performed even in a case where the sheet are reversed.

As a specific example, in a case where stapling on a right deep side is designated, stapling is required on a left front side if the sheets are reversed. Determination of whether this can be executed is performed. In a case where the scanner control unit 301 determines that the finishing processing cannot be performed (NO in step S411), in step S406, a message indicating accordingly is displayed on the UI 202. Then, in step S407, the job is interrupted.

In a case where the scanner control unit 301 determines that the finishing processing can be performed (YES in step S411), in step S404, the scanner control unit 301 scans the document set on the scanner 203, and the print data 303 is stored in the HDD 210.

Figure 6:
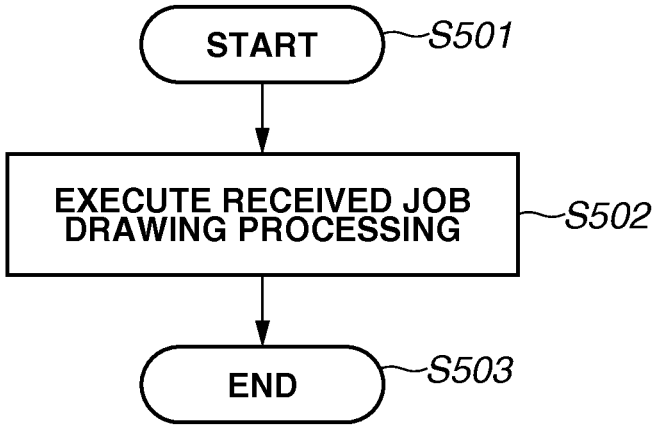
FIG. 6 is a flowchart illustrating a method for controlling the printing apparatus.

FIG. 6 is a flowchart illustrating a method for controlling the printing apparatus according to the present exemplary embodiment. This is a processing example up to the point where the print data 303 is obtained from the network 213. Each step is achieved through execution of the control program stored in the HDD 210 by the CPU 208. Hereinafter, processing will be appropriately described mainly on the module illustrated in FIG. 3.

In step S501, the processing is started, and printer description language (PDL) data is received via the I/F 207. In step S502, the data analysis unit 302 executes drawing processing to store the print data 303 in the HDD 210. Then, in step S503, the processing is ended.

In the case of the PDL data, a printer driver may impose an input limit on a personal computer (PC). However, data can be generated without using any printer driver. Accordingly, since no prior inhibition processing for obtaining data from the scanner 203 as described with reference to FIG. 6 can be expected, obtaining data is once executed, and setting items are checked in printing.

Figure 7:
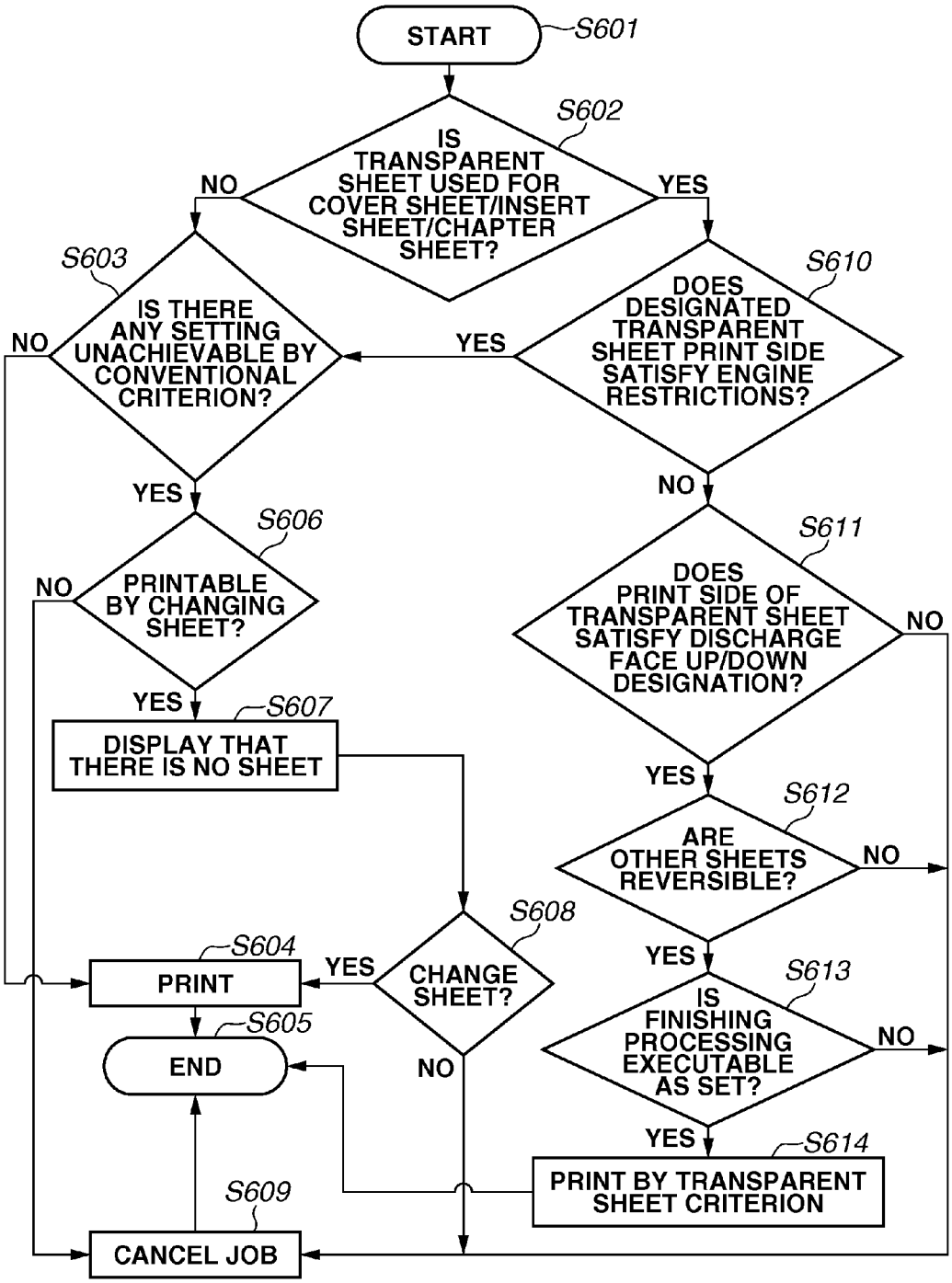
FIG. 7 is a flowchart illustrating a method for controlling the printing apparatus.

FIG. 7 is a flowchart illustrating a method for controlling the printing apparatus according to the present exemplary embodiment. This is a processing example executed by the print control unit 304 to print the print data 303.

In step S602, the print control unit 304 analyzes print setting information set in the print data 303, and determines whether there is any setting using the transparent sheet for a cover sheet, a chapter sheet, or an insert sheet. In a case where the print control unit 304 determines that there is no setting using the transparent sheet for a cover sheet, a chapter sheet, or an insert sheet (NO in step S602), the processing proceeds to step S603. In this case, the processing is similar to that of a general case. In step S603, the print control unit 304 determines whether there is any unachievable setting in the print setting information set by the user according to a conventional criterion.

In a case where the print control unit 304 determines that there is no unachievable setting in the print setting information set by the user according to the conventional criterion (NO in step S603), in other words, the setting is achievable, in step S604, the print control unit 304 controls the printer engine 211 to print the print data 303 as instructed.

On the other hand, in a case where the print control unit 304 determines that there is an unachievable setting (YES in step S603), in step S606, the print control unit 304 further determines whether printing can be executed if the sheet is changed. In a case where the print control unit 304 determines that printing can be executed if the sheet is changed (YES in step S606), in step S607, a message indicating absence of an appropriate sheet is displayed on the UI 202.

In a case where the user operates the UI 202 and changes the sheet to a printable sheet (YES in step S608), in step S604, the print control unit 304 executes printing by using the changed sheet.

On the other hand, in a case where the print control unit 304 determines that sheet changing is not permitted (NO in step S608), and in a case where the print control unit 304 determines that the printing cannot be completed only by changing the sheet (NO in step S606), in step S609, the print job is canceled.

On the other hand, in a case where the print control unit 304 determines that there is setting using the transparent sheet for a cover sheet, a chapter sheet, or an insert sheet (YES in step S602), in step S610, the print control unit 304 determines whether a print side of the transparent sheet is identical to a print side set in the printer engine 211.

In other words, in the case of the longitudinal path engine, the print control unit 304 determines whether printing is executed on the print side, of the transparent sheet, which is the side discharged to the sheet output port facing down. In the case of the straight path engine, the print control unit 304 determines whether printing is executed on the print side, of the transparent sheet, which is the side discharged to the sheet output port facing up.

In a case where the print control unit 304 determines that the print side of the transparent sheet is identical to the print side of the engine (YES in step S610), printing can be normally executed on the transparent sheet, and general print processing can be performed without performing any special processing according to the present invention. Thus, the processing from step S603 is executed.

On the other hand, in a case where the print control unit 304 determines that the print side of the transparent sheet is not identical to the print side of the engine (NO in step S610), reversing the transparent sheet is difficult. Thus, the print control unit 304 determines whether a print product can be obtained by reversing sheets other than the transparent sheet.

Specifically, the print control unit 304 checks whether the user has designated Face Up/Down of the discharge sheet in the print data 303. In a case where the print control unit 304 determines that the user has designated Face Up/Down, in step S611, the print control unit 304 determines whether the discharge sheet side of the transparent sheet satisfies the Face Up/Down designation.

In a case where the print control unit 304 determines that the discharge sheet side of the transparent sheet does not satisfy the Face Up/Down designation (NO in step S611), in step S609, the job is canceled.

As a specific example, in the printer engine 211 including the straight path illustrated in FIG. 1, in a case where printing on the front side of the transparent sheet is designated, and if "Face Up"/"Either is OK" is designated, the user can obtain a desired result. On the other hand, if "Face Down" is designated, the user cannot obtain a desired result. Therefore, the job is canceled.

On the other hand, in a case where the print control unit 304 determines that the discharge sheet side of the transparent sheet satisfies the Face Up/Down designation (YES in step S611), in step S612, the print control unit 304 performs an inquiry to the printer engine 211 to determine whether sheets other than the transparent sheet are reversible.

In a case where the print control unit 304 determines that there is a sheet not reversible (NO in step S612), in step S609, the job is canceled. On the other hand, in a case where the print control unit 304 determines that sheets other than the transparent sheet are reversible (YES in step S612), in step S613, the print control unit 304 determines whether finishing processing set in the print data 303 can be performed even in a case where the sheets are reversed.

As a specific example, in a case where stapling on a right deep side is designated, stapling is required on a left front side if the sheets are reversed. Determination of whether this can be executed is performed.

In a case where the print control unit 304 determines that the finishing processing cannot be performed (NO in step S613), in step S609, the job is canceled.

Further, in a case where the print control unit 304 determines that the finishing processing can be performed (YES in step S613), in step S614, the print control unit 304 adjusts a printing order and a print side of the print data 303 to execute printing.

Figure 8:
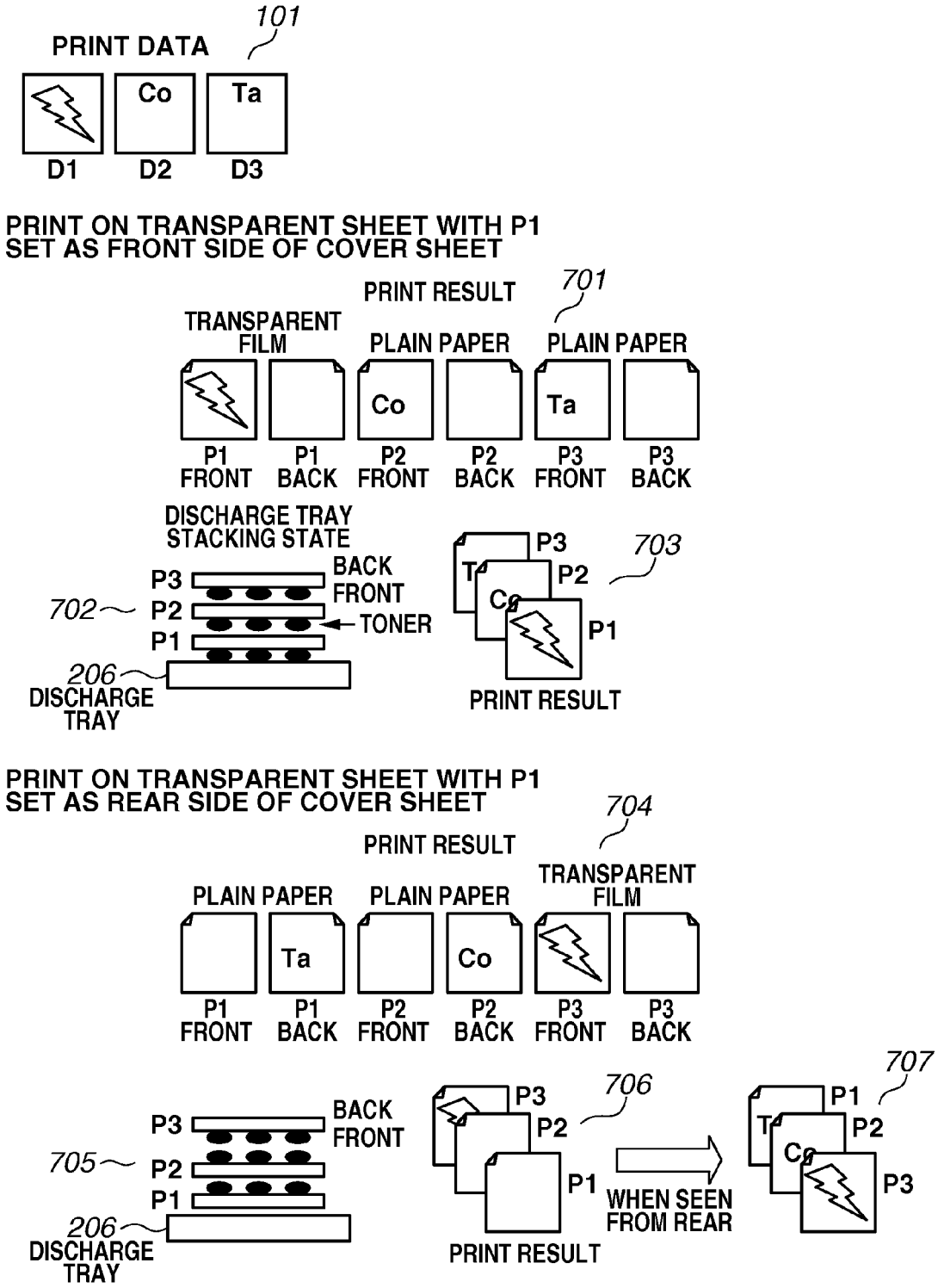
FIG. 8 is a diagram illustrating a print processing state in the printing apparatus.

FIG. 8 is a diagram illustrating a print processing state in the printing apparatus according to the present exemplary embodiment. This is a printing result example obtained by the longitudinal path engine.

In the example illustrated in FIG. 8, when data D1 of print data 101 is designated to be "printed on front side" of a cover sheet of the transparent sheet, and data D2 and D3 are designated to be printed on one side of plain paper, a print result 701 is obtained.

In the flowchart illustrated in FIG. 7, the processing is performed in order of steps S602, S610, S603, and S604. First, the transparent sheet is fed and the data D1 is printed on its front side, and pieces of plain paper are fed to P2 and P3 and the data D2 and D3 are printed on their front sides.

A stacking state 702 illustrates the state where sheets as a print result are stacked on the discharge tray 206. In the example illustrated in FIG. 8, since the printing apparatus illustrated in FIG. 2 includes the longitudinal path engine, toner is placed on the Face Down side of the transparent sheet with respect to the discharge tray. A stacking state 703 of the print result and sheets illustrates the print result seen from the discharge tray side.

On the other hand, the data D1 of the print data 101 is designated to be "printed on back side" of the cover sheet of the transparent sheet, and the data D2 and D3 are designated to be printed on one side of plain paper, a print result 704 is obtained. In the flowchart illustrated in FIG. 7, the processing is performed in order of steps S602, S610, S611, S612, S613, and S614.

As a result of changing the feeding order and the feed side with the transparent sheet set as a reference in step S614, a piece of plain paper is fed to P1 and the data D3 is printed on its back side, a piece of plain paper is fed to P2 and the data D2 is printed on its back side, and a transparent sheet is fed to P3 that is a final print page and the data D1 is printed on its front side. A stacking state 705 illustrates the state of the print result of sheets stacked on the discharge tray.

According to the present exemplary embodiment, since the printer engine 211 of the printing apparatus illustrated in FIG. 2 includes the longitudinal path, the toner is placed on the Face Down side of the transparent sheet with respect to the discharge tray 206. A stacking state 706 illustrates the print result and stacked sheets seen from the discharge tray side, and a print result 707 is a print result obtained by reversing the print result 706. When seen from the rear side, it can be understood that printing is performed on the print side desired by the user.

Figure 9:
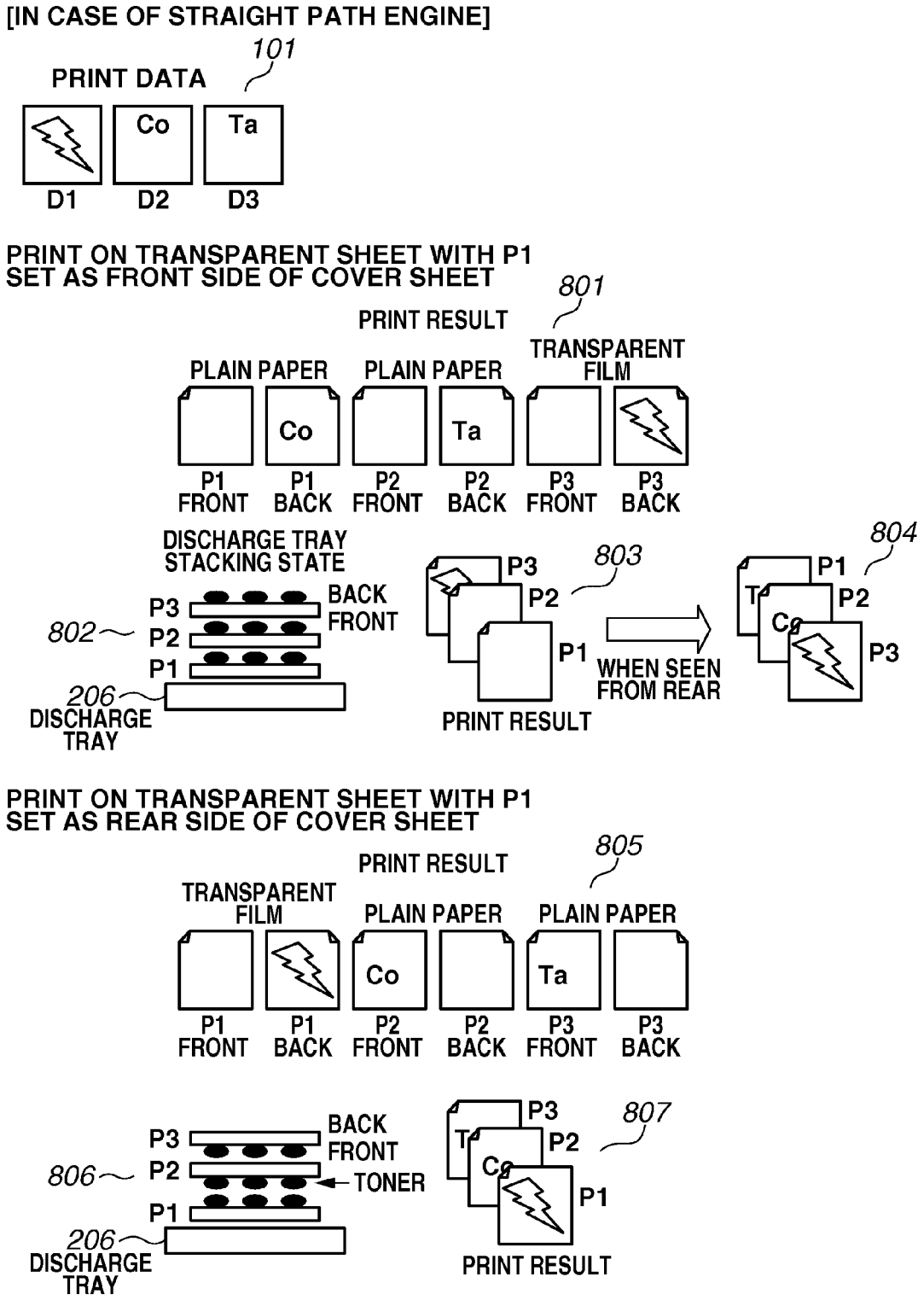
FIG. 9 is a diagram illustrating a print processing state in the printing apparatus.

FIG. 9 is a diagram illustrating a print processing state in the printing apparatus according to the present exemplary embodiment. This is a printing result example obtained by the printer engine 211 of the printing apparatus illustrated in FIG. 1 including the straight path.

In the example illustrated in FIG. 9, when data D1 of print data 101 is designated to be "printed on front side" of a cover sheet of the transparent sheet, and data D2 and D3 are designated to be printed on one side of plain paper, a print result 801 is obtained. In the flowchart illustrated in FIG. 7, the processing is performed in order of steps S602, S610, S611, S612, S613, and S614.

As a result of changing the feeding order and the feed side with the transparent sheet set as a reference in step S614, a piece of plain paper is fed to P1 and the data D3 is printed on its back side, a piece of plain paper is fed to P2 and the data D2 is printed on its back side, and a transparent sheet is fed to P3 and the data D1 is printed on its back side. A stacking state 802 illustrates the print result of sheets stacked on the discharge tray 206. According to the present exemplary embodiment, since the printer engine 211 including the straight path, toner is placed on the Face Up side of the transparent sheet with respect to the discharge tray 206. A stacking state 803 is the print result and the sheets seen from the discharge tray side, and a print result 804 is obtained by reversing the print result 803. When seen from the rear side, it can be understood that printing is carried out on the print side desired by the user.

When the data D1 of the print data 101 is designated to be "printed on back side" of the cover sheet of the transparent sheet, and the data D2 and D3 are designated to be printed on one side of plain paper, a print result 805 is obtained. In the flowchart illustrated in FIG. 7, the processing is performed in order of steps S602, S610, S603, and S604. First, the transparent sheet is fed and the data D1 is printed on its back side, and pieces of plain paper are fed to P2 and P3 and the data D2 and D3 are printed on their front sides.

A stacking state 806 illustrates the print result of the sheets stacked on the discharge tray. According to the example, since the printer engine 211 including the straight path, toner is placed on the Face UP side of the transparent sheet with respect to the discharge tray 206. A stacking state 807 illustrates the print result and sheets seen from the side of the discharge tray 206.

According to the present exemplary embodiment, whether the first print side (designated print side (front side or back side) of transparent sheet) and the second print side (specified by configuration of conveyance path included in printer engine 211) match each other is determined. In a case where the first print side and the second print side do not match each other, control is carried out as described below. With the first print side set as a reference, the printer engine 211 is controlled so as to perform switching a print side when image data of each page based on print data is printed on the transparent sheet and switching between a normal image and a mirror image of the image data printed on the print side.

Thus, the printer engine can be controlled to obtain an intended print result by adapting destination of the print side of the transparent sheet designated by the user. Specifically, the intended print result can be obtained by controlling the printer engine to switch the transparent sheet, the printing order of the pages of the sheets, and a normal image and a mirror image of the image to be formed.

According to the first exemplary embodiment, printing on the print side of the transparent sheet is executed as designated by the user. However, since the sheet is a transparent sheet, even in a case where the print side is not the side as desired, a print result may be obtained if an image is printed in a mirror image.

In the general case for a cover sheet, a chapter sheet, or an insert sheet, "printing on front side" is only permitted. On the other hand, a second exemplary embodiment provides a user advantage in that "printing on back side" (in appearance of print result) can be performed. Further, as there are more choices of print sides than the first exemplary embodiment, the second exemplary embodiment also provides a user advantage in that a probability of obtaining a print product is higher. Hereinafter, the second exemplary embodiment will be described in detail.

Figure 10:
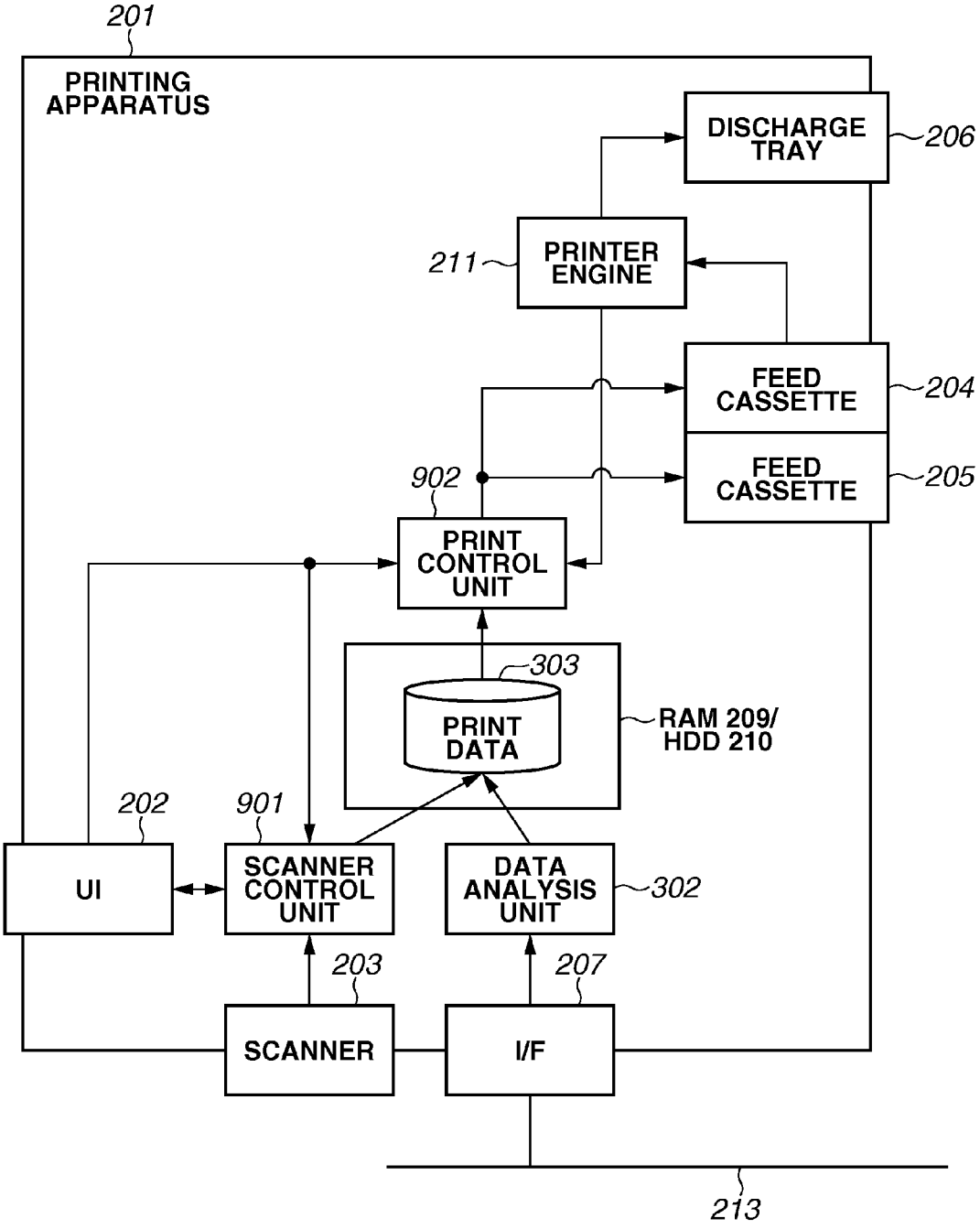
FIG. 10 is a block diagram illustrating a configuration of a software module of a printing apparatus.

FIG. 10 is a block diagram illustrating a configuration of a software module of a printing apparatus according to the present exemplary embodiment. Components similar to those illustrated in FIG. 4 are denoted by the same reference numerals.

The printing apparatus 201 illustrated in FIG. 10 includes a scanner control unit 901 and a print control unit 902.

Figure 11:
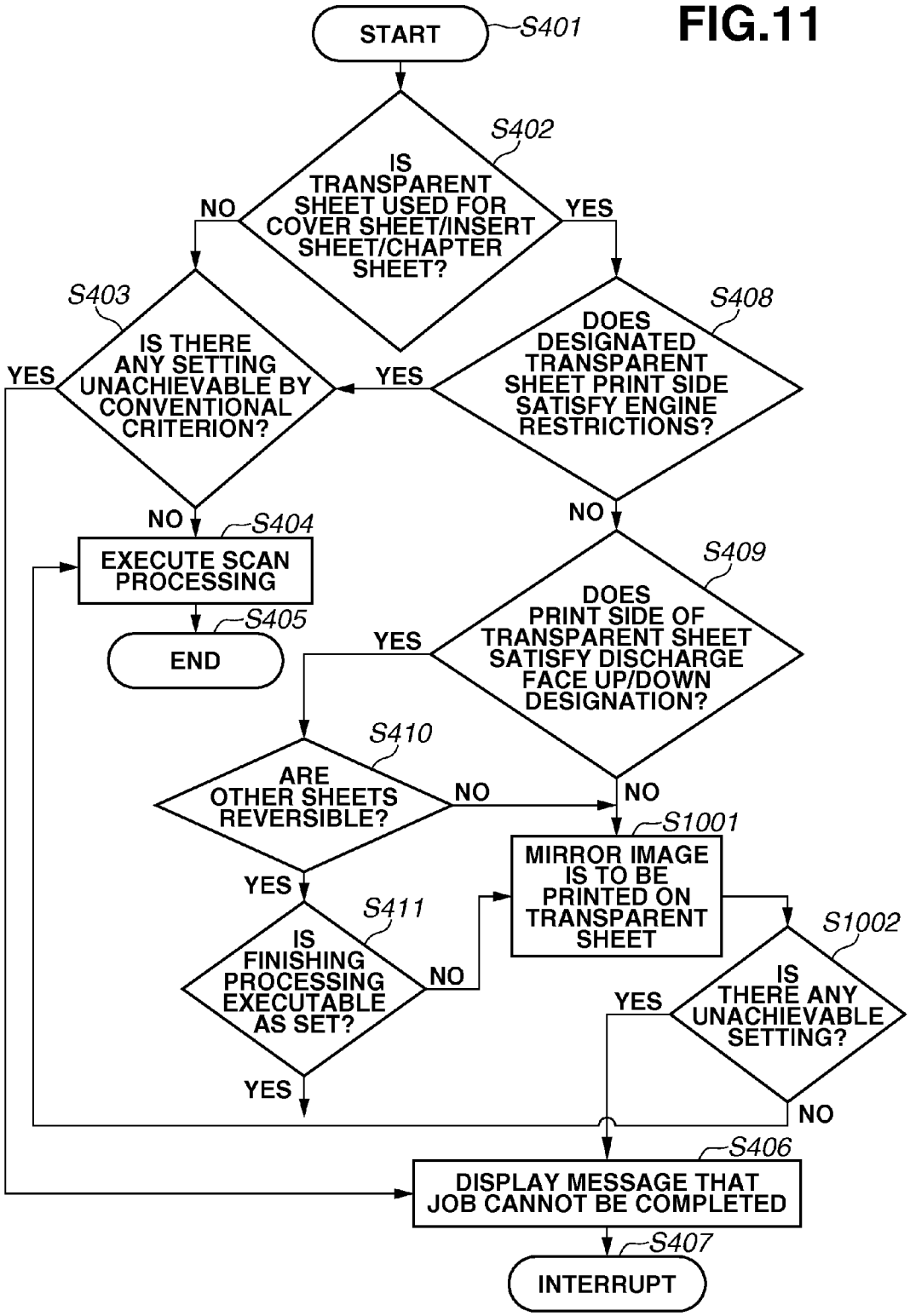
FIG. 11 is a flowchart illustrating a method for controlling the printing apparatus.

FIG. 11 is a flowchart illustrating a method for controlling the printing apparatus according to the present exemplary embodiment. This is a processing example executed by the scanner control unit 901 up to the point where print data 303 based on a document image read by a scanner 203 is obtained. Each step is achieved through execution of a control program stored in a HDD 210 by a CPU 208. Hereinafter, processing will be appropriately described mainly on the module illustrated in FIG. 10. Steps different from those illustrated in FIG. 5 will be mainly described.

In a case where the scanner control unit 901 determines that the print side of the transparent sheet is not identical to the discharge Face Up/Down designation (NO in step S409), in step S1001, the scanner control unit 901 treats an image to be printed on the transparent sheet as an image to be printed in a mirror image. Then, in step S1002, the scanner control unit 901 determines a print side of a sheet other than the transparent sheet and whether finishing processing can be performed.

On the other hand, in a case where the scanner control unit 901 determines that the setting enables printing (YES in step S1002), in step S404, the scanner control unit 901 causes a scanner 203 to start scanning of a set document, and stores the print data 303 in the HDD 210.

On the other hand, in a case where the scanner control unit 901 determines that the setting does not enable printing (NO in step S1002), in step S406, a message indicating accordingly is displayed on a UI 202. In step S407, a job is interrupted. Actual mirror-image processing of the print data is executed by the print control unit 902 during printing since the mirror-image processing and printing of PDL data share common processing.

In a case where the print control unit 902 determines that sheets other than the transparent sheet cannot be reversible (NO in step S410), from step S1001, the print control unit 902 checks whether printing can be completed if the image to be printed on the transparent sheet is treated as the image to be printed in a mirror image.

In a case where the print control unit 902 determines that the finishing processing cannot be performed as set due to reversing of the sheet (NO in step S411), from step S1001, the print control unit 902 checks whether printing can be completed if the image to be printed on the transparent sheet is treated as the image to be printed in a mirror image.

FIG. 12 is a flowchart illustrating a method for controlling the printing apparatus according to the present exemplary embodiment. This is a processing example executed by the print control unit 902 for printing print data 303. Each step is achieved through execution of a control program stored in the HDD 210 by the CPU 208. Hereinafter, processing will be appropriately described mainly on the module illustrated in FIG. 9. Steps different from those illustrated in FIG. 7 will be mainly described.

In a case where the print control unit 902 determines that the print side of the transparent sheet does not satisfy the Face Up/Down designation (NO in step S611), in step S1101, the print control unit 902 treats an image to be printed on the transparent sheet as an image to be printed in a mirror image. Then, in step S1102, the print control unit 902 determines a print side of a sheet other than the transparent sheet and whether finishing processing can be performed.

Here, in a case where the print control unit 902 determines that the setting enables printing, in step S1103, a mirror image is printed on the transparent sheet. In a case where the print control unit 902 determines that the setting does not enable printing, in step S609, the job is canceled.

Further, in a case where the print control unit 902 determines that sheets other than the transparent sheet cannot be reversible (NO in step S612), from step S1101, the print control unit 902 checks whether printing can be completed if an image to be printed on the transparent sheet is treated as an image to be printed in a mirror image.

In a case where the print control unit 902 determines that the finishing processing cannot be performed as set (NO in step S613), from step S1101, the print control unit 902 checks whether printing can be completed if an image to be printed on the transparent sheet is treated as an image to be printed in a mirror image.

Figure 13:
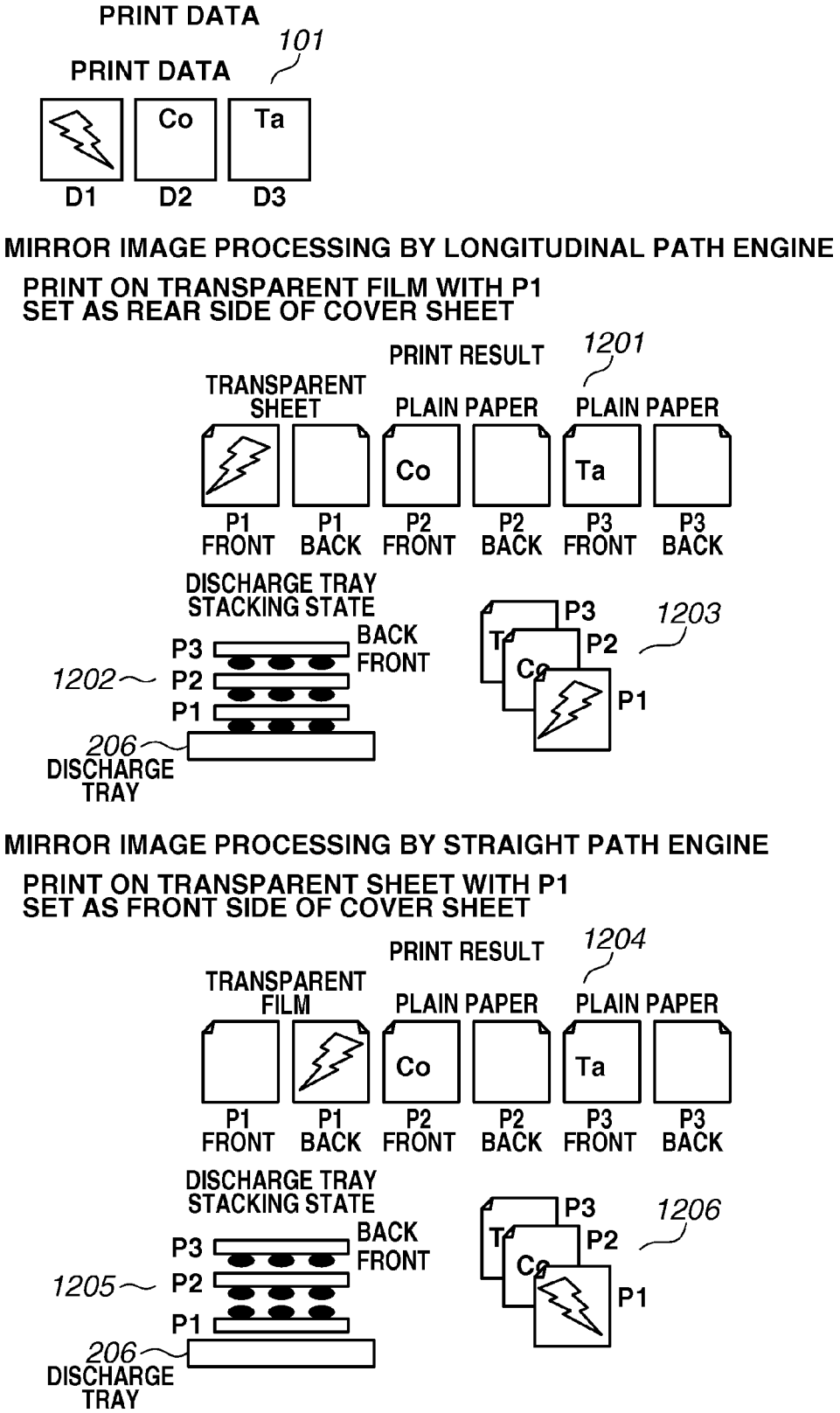
FIG. 13 is a diagram illustrating a print result on a transparent sheet.

FIG. 13 is a diagram illustrating a print result on the transparent sheet in the printing apparatus according to the present exemplary embodiment. A print result of mirror-image processing executed in a case where a printable side of the transparent sheet and a designated print side are different as described above will be described.

In a case where data D1 of print data 101 is designated to be "printed on back side" of a cover sheet of the transparent sheet in the longitudinal path engine, data D2 and D3 are printed on one side of plain paper, and the data D1 is determined to be printed in a mirror image, a print result 1201 is obtained. A stacking state 1202 is the print result of sheets stacked on the discharge tray. Since the printer engine 211 according to this example includes the longitudinal path, toner is placed on the Face Down side of the transparent sheet with respect to the discharge tray 206. A stacking state 1203 illustrates the print result and sheets seen from the discharge tray side.

On the other hand, in the printer engine 211 of the printing apparatus illustrated in FIG. 1 including the straight path, the data D1 of the print data 101 is designated to be "printed on front side" of the cover sheet of the transparent sheet. In a case where the data D2 and D3 are printed on one side of plain paper, and the data D1 is determined to be printed in a mirror image, a print result 1204 is obtained. A stacking state 1205 is the print result of sheets stacked on the discharge tray. According to the present exemplary embodiment, since the printer engine 211 includes the straight path, toner is placed on the Face Up side of the transparent sheet with respect to the discharge tray 206. A stacking state 1206 illustrates the print result and sheets seen from the discharge tray side.

According to the second exemplary embodiment, the mirror image printing is automatically performed in a case where the processing cannot be carried out as instructed by the user. Alternatively, similar processing can be obtained even in a case where the user selects permission/inhibition of the mirror image printing.

Figure 14:
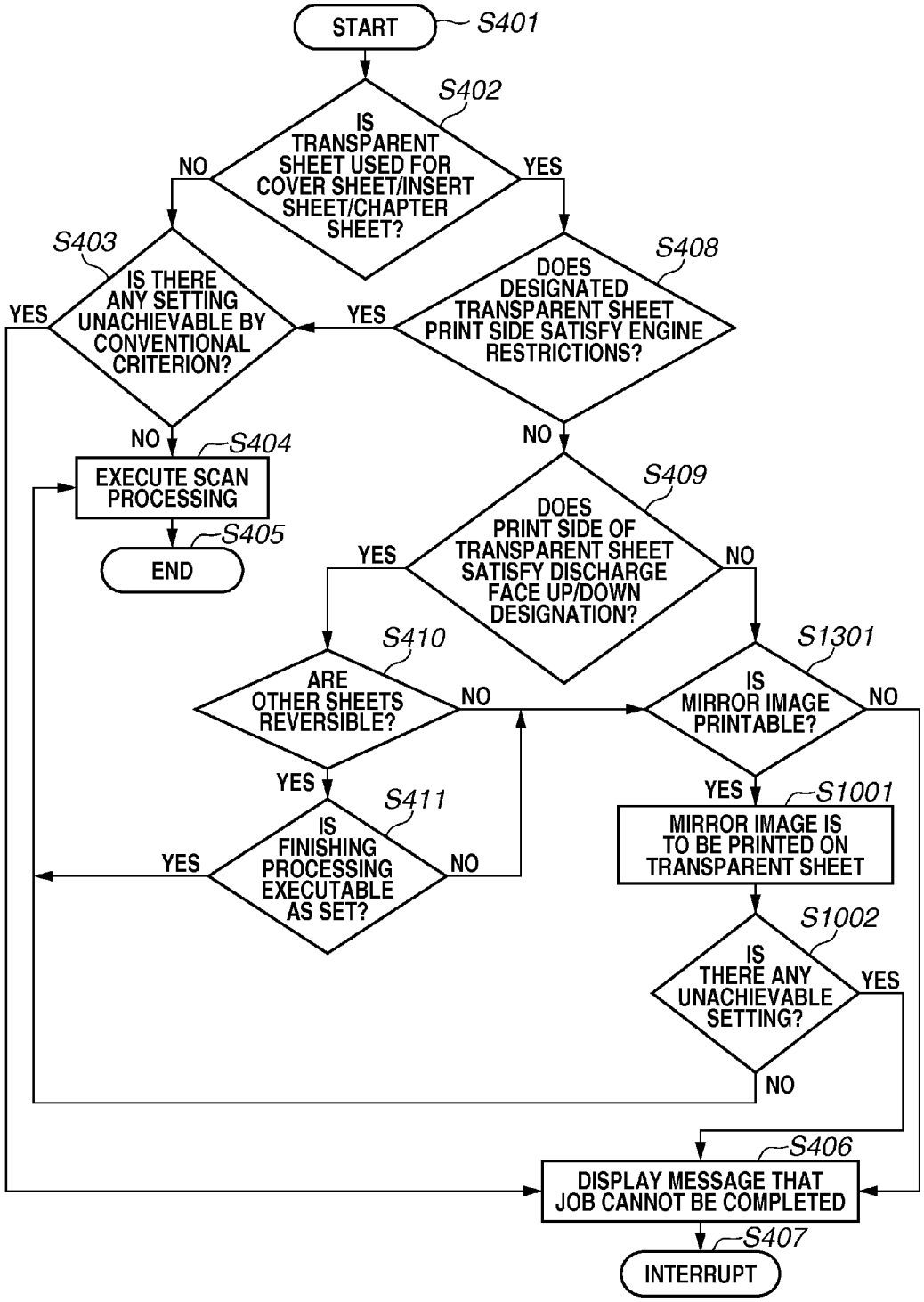
FIG. 14 is a flowchart illustrating a method for controlling a printing apparatus.
Figure 16:
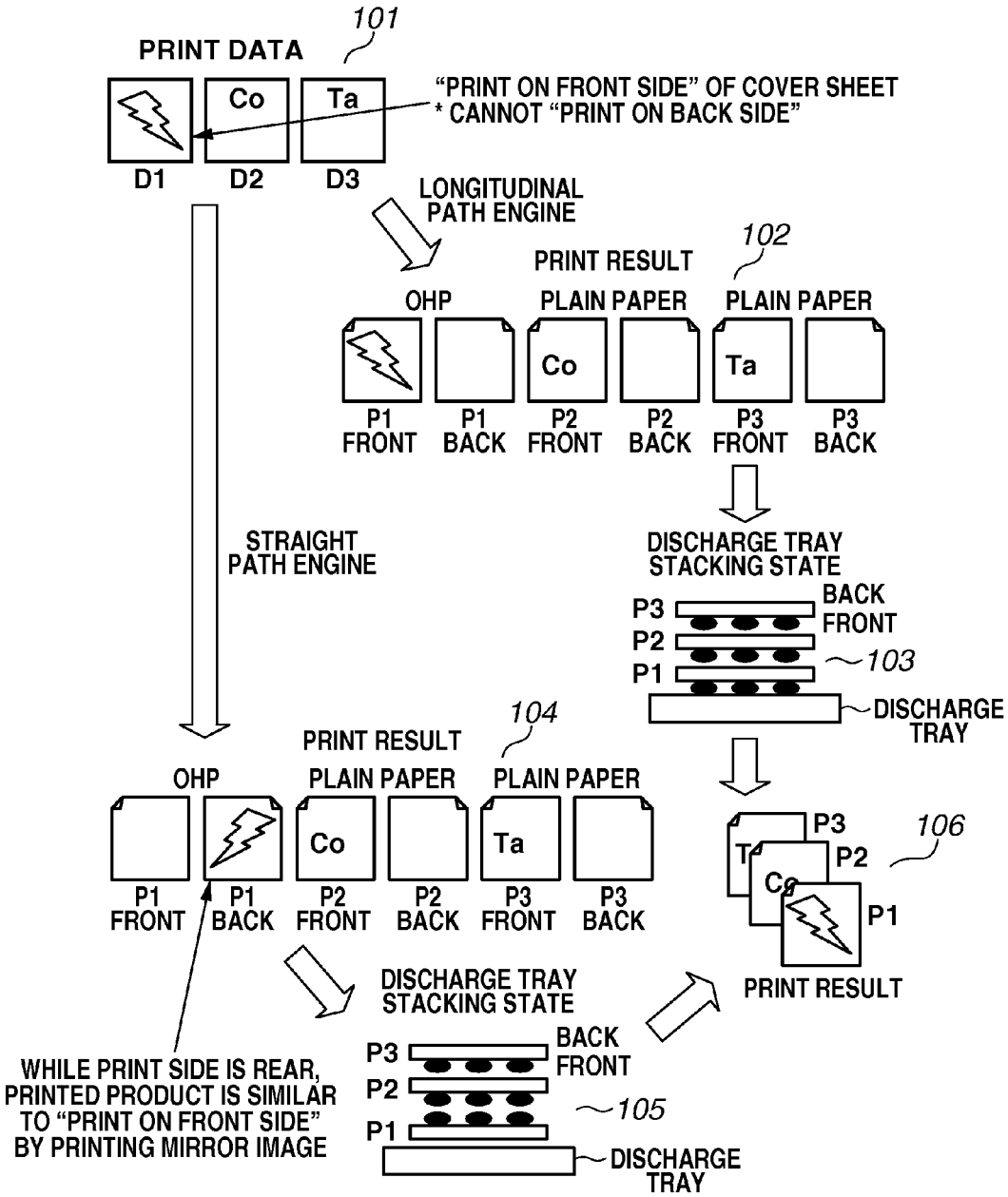
FIG. 16 is a diagram illustrating a print side on which the printing apparatus executes printing and a print status thereof.

FIG. 14 is a flowchart illustrating a method for controlling a printing apparatus according to a third exemplary embodiment. Each step is achieved through execution of a control program stored in a HDD 210 by a CPU 208. Hereinafter, processing will be appropriately described mainly on the module illustrated in FIG. 10. Steps different from those illustrated in FIGS. 5 and 7 will be mainly described.

Before step S1001, in step S1301, a scanner control unit 901 determines whether mirror image printing is permitted. In a case where the scanner control unit 901 determines that a user permits mirror image printing (YES in step S1301), the processing from step S1001 is executed. In a case where the scanner control unit 901 determines that the user does not permit mirror image printing (NO in step S1301), the processing from step S406 is executed.

FIG. 15 is a flowchart illustrating a method for controlling the printing apparatus according to the present exemplary embodiment. This is a print processing example of print data 303 executed by a print control unit 902 in a case where the print control unit 902 includes determination processing for "permission/inhibition" of the mirror image printing. Each step is achieved through execution of a control program stored in the HDD 210 by the CPU 208. Hereinafter, processing will be appropriately described mainly on the module illustrated in FIG. 10. Steps different from those illustrated in FIGS. 5 and 7 will be mainly described.

Before step S1101, in step S1301, the print control unit 902 determines whether mirror image printing is permitted. In a case where the print control unit 902 determines that the user permits mirror image printing (YES in step S1301), the processing from step S1101 is executed. In a case where the print control unit 902 determines that the user does not permit mirror image printing (NO in step S1301), the processing from step S609 is executed.

According to the second exemplary embodiment, the mirror image printing is automatically performed in a case where the processing cannot be carried out as instructed by the user. Alternatively, similar processing can be obtained even in a case where a printing machine retains information, for example, according to a market where a printing apparatus is provided for, in other words, in a printing machine of a Point of Distribution (POD) system where the user wishes to control all, mirror image printing is not permitted, in other words, in a printing machine of an office system where much time and labor are avoided, mirror image printing is permitted.

According to each of the exemplary embodiments, in a case where a sheet, such as a transparent sheet on which reverse or two-sided printing is difficult is used for a cover sheet, a chapter sheet, or an insert sheet, "printing on front side" and "printing on back side" are enabled. Further, a desired print result can be obtained by a single job while a demand that priority be placed on a side to be printed or a print result be good enough as long as it is correct in appearance is accommodated.

Each process of the present invention can also be achieved through execution of software (program) acquired via a network or various types of storage media by a processing apparatus (CPU or processor) such as a PC (computer).

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-068258 filed Mar. 28, 2014, which is hereby incorporated by reference herein in its entirety.

What is claimed is:

1. A printing apparatus comprising:

a printing unit configured to print an image on a sheet;

a receiving unit configured to receive a print job in which printing of a first page on a transparent sheet which is to be used as a cover sheet and cannot be reversed, and printing of a second page on a non-transparent sheet which can be reversed are designated; and a control unit configured to, (i) in a case where printing of the first page on a front side of the cover sheet is designated in the received print job, perform a first control in which the second page is printed on a front surface on the non-transparent sheet after the first page is printed on a front surface of the transparent sheet, and (ii) in a case where printing of the first page on a back side of the cover sheet is designated in the received print job, perform a second control in which the first page is printed on a front surface of the transparent sheet after the second page is printed on a back surface of the non-transparent sheet.

2. The printing apparatus according to claim 1, further comprising a sheet storage unit configured to store sheets, wherein in a case where a sheet is conveyed from the sheet storage unit without being reversed, printing by the printing unit is performed on a front surface of the conveyed sheet.

3. A printing apparatus comprising:

a printing unit configured to print an image on a sheet;

a receiving unit configured to receive a print job in which printing of a first page on a transparent sheet which is to be used as a cover sheet and cannot be reversed, and printing of a second page on a non-transparent sheet which can be reversed, are designated; and a control unit configured to, (i) in a case where printing of the first page on a front surface of the cover sheet is designated in the received print job, perform a first control in which the first page is printed on a back surface of the transparent sheet after the second page is printed on a back surface of the non-transparent sheet, (ii) in a case where printing of the first page on a back surface of the cover sheet is designated in the received print job, perform a second control in which the second page is printed on a front surface of the non-transparent sheet after the first page is printed on a back surface of the transparent sheet.

4. The printing apparatus according to claim 3, further comprising a sheet storage unit configured to store sheets, wherein in a case where a sheet is conveyed from the sheet storage unit without being reversed, printing by the printing unit is performed on a back surface of the conveyed sheet.

5. A control method for controlling a printing apparatus that prints an image on a sheet, the control method comprising:

receiving a print job in which printing of a first page on a transparent sheet which is to be used as a cover sheet and cannot be reversed, and printing of a second page on a non-transparent sheet which can be reversed, are designated;

in a case where printing of the first page on a front surface of the cover sheet is designated in the received print job, performing a first control in which the second page is printed on a front surface of the non-transparent sheet after the first page is printed on a front surface of the transparent sheet; and in a case where printing of the first page on a back surface of the cover sheet is designated in the received print job, performing a second control in which the first page is printed on a front surface of the transparent sheet after the second page is printed on a back surface of the non-transparent sheet.

6. A control method for controlling a printing apparatus that prints an image on a sheet, the control method comprising:

receiving a print job in which printing of a first page on a transparent sheet which is used as a cover sheet and which cannot be reversed, and printing of a second page on a non-transparent sheet which can be reversed, are designated;

in a case where printing of the first page on a front side of the cover sheet in the received print job, performing a first control in which the first page is printed on a back surface of the transparent sheet after the second page is printed on a back surface of the non-transparent sheet; and in a case where printing of the first page on a back side of the cover sheet is designated in the received print job, performing a second control in which the second page is printed on a front surface of the non-transparent sheet after the first page is printed on a back surface of the transparent sheet.

7. A non-transitory computer-readable storage medium storing a program that causes a computer to perform a method for controlling a printing apparatus that prints an image on a sheet, the method comprising:

receiving a print job in which printing of a first page on a transparent sheet which is used as a cover sheet and which cannot be reversed, and printing of a second page on a non-transparent sheet which can be reversed, are designated;

in a case where printing of the first page on a front surface of the cover sheet is designated in the received print job, performing a first control in which the second page is printed on a front surface of the non-transparent sheet after the first page is printed on a front surface of the transparent sheet; and in a case where printing of the first page on a back surface of the cover sheet, performing a second control in which the first page is printed on a front surface of the transparent sheet after the second page is printed on a back surface of the non-transparent sheet.

8. A non-transitory computer-readable storage medium storing a program that causes a computer to perform a method for controlling a printing apparatus that prints an image on a sheet, the method comprising:

receiving a print job in which printing of a first page on a transparent sheet which is used as a cover sheet and which cannot be reversed, and printing of a second page on a non-transparent sheet which can be reversed, are designated;

in a case where printing of the first page on a front side of the cover sheet is designated in the received print job, performing a first control in which the first page is printed on a back surface of the transparent sheet after the second page is printed on a back surface of the non-transparent sheet; and in a case where printing of the first page on a back side of the cover sheet is designated in the received print job, performing a second control in which the second page is printed on a front surface of the non-transparent sheet after the first page is printed on a back surface of the transparent sheet.

* * * * *